US008616859B2

(12) United States Patent
Kroeg et al.

(10) Patent No.: US 8,616,859 B2
(45) Date of Patent: Dec. 31, 2013

(54) FAN

(75) Inventors: Rolf Kroeg, Buehlertal (DE); Klaus Weickenmeier, Lauf (DE); Klaus Linnenbrock, Buehl (DE); Thomas Helming, Baden-Baden (DE)

(73) Assignee: Robert Bosch GmbH, Stuttgart (DE)

( * ) Notice: Subject to any disclaimer, the term of this patent is extended or adjusted under 35 U.S.C. 154(b) by 470 days.

(21) Appl. No.: 12/744,167

(22) PCT Filed: Sep. 23, 2008

(86) PCT No.: PCT/EP2008/062691

§ 371 (c)(1),
(2), (4) Date: Nov. 2, 2010

(87) PCT Pub. No.: WO2009/065649

PCT Pub. Date: May 28, 2009

(65) Prior Publication Data

US 2011/0036312 A1 Feb. 17, 2011

(30) Foreign Application Priority Data

Nov. 22, 2007 (DE) ..... 10 2007 056 205

(51) Int. Cl.
*F04B 17/00* (2006.01)
*F04B 35/00* (2006.01)

(52) U.S. Cl.
USPC ..... 417/360; 417/423.15; 248/612; 248/674

(58) Field of Classification Search
USPC ..... 417/360, 423.15; 123/41.12; 248/612, 248/674; 415/191, 211.2, 213.1, 208.1, 415/208.2; 416/169 A
See application file for complete search history.

(56) References Cited

U.S. PATENT DOCUMENTS

| | | | | |
|---|---|---|---|---|
| 5,100,713 | A * | 3/1992 | Homma et al. | 428/102 |
| 6,074,182 | A * | 6/2000 | Matson | 417/423.15 |
| 6,158,979 | A * | 12/2000 | Couetoux et al. | 417/360 |
| 6,360,703 | B1 * | 3/2002 | Rahbar et al. | 123/41.49 |
| 6,899,521 | B2 * | 5/2005 | Horng et al. | 415/208.2 |
| 6,939,105 | B2 * | 9/2005 | Horng et al. | 415/191 |
| 7,118,332 | B2 * | 10/2006 | Horng et al. | 415/208.2 |
| 2005/0042088 | A1 | 2/2005 | Horski et al. | |
| 2005/0232754 | A1 | 10/2005 | Ku et al. | |
| 2007/0041857 | A1 | 2/2007 | Fleig | |
| 2007/0048138 | A1 | 3/2007 | Horski et al. | |
| 2007/0060037 | A1 | 3/2007 | Kim et al. | |

(Continued)

FOREIGN PATENT DOCUMENTS

| | | |
|---|---|---|
| DE | 10 2005 021 676 | 11/2006 |
| DE | 20 2007 008 216 | 11/2007 |
| EP | 1 754 892 | 2/2007 |

*Primary Examiner* — Devon Kramer
*Assistant Examiner* — Christopher Maxey
(74) *Attorney, Agent, or Firm* — Merchant & Gould P.C.

(57) ABSTRACT

The invention relates to a fan, particularly for cooling an internal combustion engine of a vehicle, having an attachment unit, an electric drive motor, and a fan wheel rotating about the fan axis, wherein the attachment unit has a frame, from which bars protrude that cross through an air opening, said bars carrying an attachment element serving to attach the drive motor. The invention proposes that each of the bars (6) have a cross-sectional contour, wherein at least one cross bar (18) extending laterally in the direction of the fan axis (9) is configured between end regions (14, 15) of the bar (6) extending in the direction of the fan axis (9), defining a bar width (b).

7 Claims, 1 Drawing Sheet

(56) References Cited

U.S. PATENT DOCUMENTS

2008/0089798 A1* 4/2008 Litvin ..... 417/423.15
2009/0090314 A1* 4/2009 Ulrich et al. ..... 123/41.49
2010/0300648 A1* 12/2010 Grantham ..... 165/55
2011/0243723 A1* 10/2011 Chen ..... 415/208.1
2011/0273038 A1* 11/2011 Naman et al. ..... 310/58

* cited by examiner

FAN

This application is a National Stage Application of PCT/EP2008/062691, filed 23 Sep. 2008, which claims benefit of Ser. No. 10 2007 056 205.7, filed 22 Nov. 2007 in Germany and which applications are incorporated herein by reference. To the extent appropriate, a claim of priority is made to each of the above disclosed applications.

TECHNICAL FIELD

The invention relates to a fan, particularly for cooling an internal combustion engine of a vehicle, having an attachment unit, an electric drive motor and a fan wheel rotating about the fan axis, wherein the attachment unit has a frame, from which bars protrude that cross through an air opening, said bars carrying an attachment element serving to attach the drive motor.

SUMMARY

Such fans, particularly fan modules, for the cooling of internal combustion engines of vehicles are known. Said fans are provided with an attachment unit having a frame, with which they can be attached to a vehicle radiator. The attachment unit further supports an electric drive motor, whose shaft extending along the fan axis is equipped with a fan wheel. An air opening, in whose center the electric drive motor is disposed, passes through the frame. In order to hold said drive motor, bars that cross through the air opening protrude from the frame, said bars carrying an attachment element, whereat the drive motor equipped with the fan wheel is attached. During operation the fan wheel delivers an air flow, which passes through the air opening and past the bars. In order to keep the flow resistance and the noise as low as possible, it is known from the technical field to arrange the bars at a pitch-angle. Moreover, the profile of said bars can be configured like guide blades. The disadvantage of implementing the aforementioned pitch-angle and/or the guide-blade structure is a rather difficult technical construction of an injection molding tool for producing the attachment unit. The attachment unit is, for example, produced from plastic using a multi-piece plastics injection molding tool, which due to the pitch-angle of the attachment unit has to have a stepped injection molding tool joint. The stepped formation causes the costs of manufacturing and material to be high for producing the injection molding tool. Bars are also known from the technical field, which in fact have a relatively high stability because they are, for example, configured U-shaped in cross-section. Said bars cannot, however, put a pitch-angle into effect and therefore entail a relatively high flow resistance, which acts in proportion to their projected surface. The projected surface corresponds to the direction of flow of the air flow passing through the air opening, the direction of flow forming an acute angle with the direction of the fan axis.

The task underlying the invention is therefore to create a fan of the type mentioned at the beginning of the application, which has an attachment unit with bars of high rigidity and can be easily manufactured. Provision can preferably be made for the projected surface of the bars according to the invention to be selected such that only a small flow resistance arises.

This task is thereby solved according to the invention in that each of the bars has a cross-sectional contour, wherein at least one cross bar extending laterally to the direction of the fan axis is configured between end regions of the bar extending in the direction of the fan axis and defining a bar width. On account of this cross bar, which can be disposed in the center between the end regions that define the bar width or also outside said center, the rigidity of such a bar is substantially increased so that the drive motor can be held stably and essentially vibration-free.

Provision is made according to a modification of the invention for the cross bar to extend at a right angle to the end regions. The end regions preferably extend in a straight line in the direction of the fan axis.

Provision is made according to a preferred embodiment for the respective bar to have a Z-shaped cross-sectional contour. That means that a connecting cross bar extends between two end regions, which extend offset and parallel to one another, the end regions forming in each case a 90E angle with the cross bar.

Provision can alternatively be made for the bar to have an H-shaped cross-sectional contour or an h-shaped cross-sectional contour. It is also conceivable for the h-contour to be present in mirror image form, i.e. the "h" is turned around its upstroke axis.

Provision is made according to a particularly preferred example of embodiment for the attachment unit to be an injection molded part, in particular a plastic injection molded part.

The attachment unit can accordingly be manufactured in an injection molding process, in particular in a plastic injection molding process, by using an injection molding tool, in particular a plastics injection molding tool. In order to achieve a simple demoldability, the web-like end regions and the at least one cross bar run perpendicularly to each other, the end regions extending in the direction of the fan axis.

With regard to the configuration of the bar with a Z-shaped cross-sectional contour, a particularly favorable flow resistance results if the arrangement is such that the offset of the end regions formed by the cross bar points in a direction which corresponds to a lateral component of the direction of flow. A vectorial resolution of the throughflow direction of the air in the region of the air opening is understood by "component" in such a manner that a component sets the direction of flow in the direction of the fan axis and another component, namely the lateral component, sets said direction of flow laterally to the direction of the fan longitudinal axis, in particular perpendicularly thereto.

BRIEF DESCRIPTION OF THE DRAWINGS

The drawings illustrate the invention with the aid of an example of embodiment and namely show.

DETAILED DESCRIPTION

Figure 1:
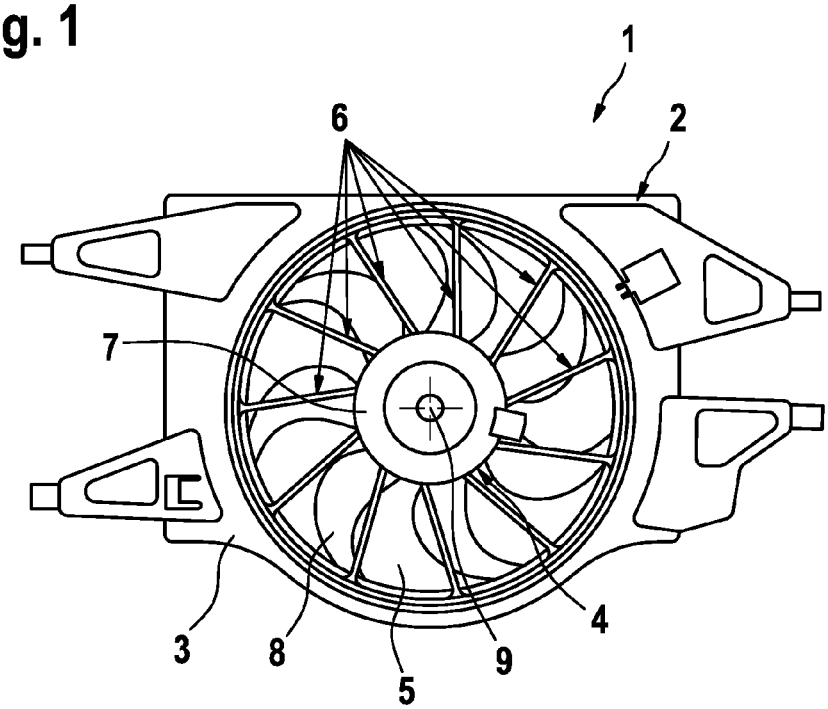
FIG. 1 a top view of the fan.

FIG. 1 shows a fan 1, which is used for cooling an unspecified internal combustion engine of a motor vehicle. The fan 1 has an attachment unit 2, which has a frame 3, an attachment element 4 and bars 6 extending between said attachment element 4 and said frame 3 that cross through an air opening 5. An electric drive motor 7, on whose shaft a fan wheel 8 is disposed, is attached to the attachment element 4. When the fan 1 is operating, the fan wheel 8 delivers an air flow, which passes through an air opening 5 and cools a radiator of the aforementioned internal combustion engine.

It can be seen in FIG. 1 that the individual bars 6 do not extend radially to the shaft of the electric drive motor 7 but are disposed offset to the radial direction. The shaft of the electric drive motor 7 with respect to its longitudinal extension defines a fan axis 9.

Figure 2:
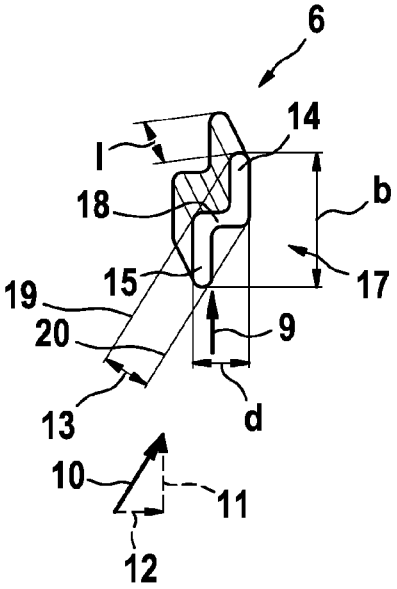
FIG. 2 a perspective view of a section of a bar of an attachment unit of the fan to illustrate the bar cross-sectional contour, FIG. 3 an additional example of embodiment corresponding to FIG. 2 and FIG. 4 an additional example of embodiment corresponding to FIG. 2.
Figure 3:
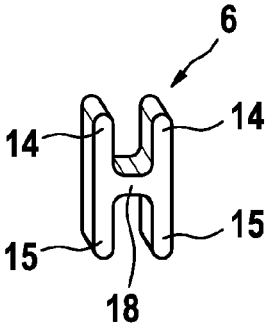
Figure 4:
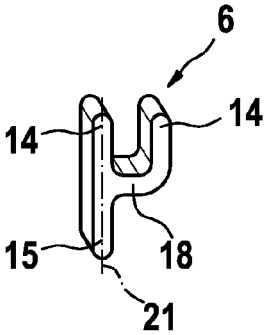

FIGS. 2 to 4 show partial sections of different embodiments of the bars 6. The cross-sectional structure of the corresponding section of the respective bar 6 is depicted in each case—in perspective view. In the example of embodiment of FIG. 2, the direction of the bar length is indicated by an arrow denoted with the letter I. The bar width is denoted with the letter b and the bar thickness with the letter d. Furthermore, the direction of flow, respectively throughflow direction, of the air flow passing through the air opening 5 is indicated by the reference numeral 10, which can be resolved into a component 11 and 12, the component 11 extending in the direction of the fan axis 9 and the component 12 in a 90E angle to the direction of the fan axis 9. A projected surface is indicated by the double arrow 13, which fixes the bar 6 with respect to the throughflow direction 10.

It can be seen in FIG. 2 that the bar 6 has two end regions 14 and 15, which define the bar width b. Said end regions 14 and 15 are embodied in a webbed or rectilinear manner and extend in each case in the direction of the fan axis 9. The two end regions 14 and 15 are connected by means of a cross bar 18 in the approximately central region with respect to the bar width b. The example of embodiment of FIG. 2 therefore has altogether one bar 6, which has a Z-shaped cross-sectional contour. Because the lengths of the end regions 14 and 15 according to FIG. 2 are selected such that flow paths 19 and 20 extending in the throughflow direction are tangent to the respective ends of the end regions 14 and 15 and the ends of the cross bar 18, the bar 6 of the example of embodiment of FIG. 2 has only a very small projected surface (double arrow 13) and for that reason produces only a very small flow resistance.

In the example of embodiment of FIG. 3, the bar 6 is provided with a cross-sectional contour, which is configured H-shaped. As a result two end regions 14 and two end regions 15 are present, which in each case extend in the direction of the fan axis 9, as well as—at a 90E angle thereto—a cross bar 18, which has a connecting effect.

In the example of embodiment of FIG. 4, a bar 6 with a cross-sectional profile that corresponds to an upside down h results, wherein the h is mirrored around its upstroke axis 21. As a result, two end regions 14 and an end region 15 ensue. In so doing, one of the end regions 14 with a 90E angle passes into a cross bar, which is connected to the remaining part of the bar 6.

Provision is particularly made for the attachment unit 2 to be manufactured in one piece as a plastic injected molded part, i.e. the frame 3, the bars 6 and the attachment element 4 are integrally produced in the injection molding process, in particular in the plastic injection molding process. Because the bars 6 of the examples of embodiment of FIGS. 3 and 4 only have bases, which extend either in the direction of the fan longitudinal axis 9 or in a 90E angle thereto (cross bar 18), the manufacture can occur using a simple, separable injection molding tool, in particular a plastics injection molding tool, which does not require a stepping of the injection molding tool joint or the like, because the bars of the attachment unit do not have a pitch-angle.

The invention claimed is:

1. A fan, capable of being used for cooling an internal combustion engine of a vehicle, comprising:

an attachment unit;

an electric drive motor; and a fan wheel rotating about fan axis, wherein the attachment unit has a frame, from which bars protrude that cross through an air opening, said bars carrying an attachment element serving to attach the drive motor;

wherein each of the bars has a cross-sectional contour in the direction of the fan axis and across the length of the bar, the cross-sectional contour comprising a plurality of end regions extending in the direction of the fan axis and at least one cross bar extending laterally to the direction of the fan axis and to the length of the bar wherein the end regions of the bar define a bar width, the cross bar connecting the end regions and being located in an approximately central region of the bar with respect to the bar width;

wherein the cross bar and the end regions each continuously extend from the attachment element to the frame; and wherein the frame is capable of being attached to a radiator of the internal combustion engine.

2. The fan according to claim 1, wherein the cross bar extends perpendicularly to the end regions.

3. The fan according to claim 1, wherein the bar has a Z-shaped cross-sectional contour.

4. The fan according to claim 1, wherein the bar has an H-shaped cross-sectional contour having at least four end regions extending in the direction of the fan axis.

5. The fan according to claim 1, wherein the bar has an h-shaped or the mirror image of an h-shaped cross-sectional contour.

6. The fan according to claim 1, wherein the attachment unit is a plastic injection molded part.

7. The fan according to claim 4, wherein each of the end regions extends a substantially equal distance from the cross bar in the direction of the fan axis.

* * * * *